United States Patent [19]

Bauman et al.

[11] Patent Number: 4,614,922

[45] Date of Patent: Sep. 30, 1986

[54] COMPACT DELAY LINE

[75] Inventors: Ralph E. Bauman, Londonderry; Horace W. Seymour, III, Manchester, both of N.H.

[73] Assignee: Sanders Associates, Inc., Nashua, N.H.

[21] Appl. No.: 658,006

[22] Filed: Oct. 5, 1984

[51] Int. Cl.[4] ..... H01P 9/00; H01P 3/08

[52] U.S. Cl. ..... 333/161; 333/156; 333/160; 333/246; 29/600

[58] Field of Search ..... 333/160, 161, 245, 246, 333/243, 206, 207, 219, 222, 227, 116, 238, 156, 157, 162, 163; 29/600; 331/101

[56] References Cited

U.S. PATENT DOCUMENTS

| | | | |
|---|---|---|---|
| 3,135,935 | 6/1964 | Engelbrecht | 29/600 X |
| 3,157,847 | 11/1964 | Williams | 29/600 X |
| 3,621,478 | 4/1970 | Johnson | 333/238 X |
| 3,863,181 | 1/1975 | Glance et al. | 333/246 X |
| 3,969,689 | 7/1976 | Corrons et al. | 331/101 |
| 4,210,881 | 7/1980 | Rubin | 333/246 X |
| 4,313,095 | 1/1982 | Jean-Frederick | 333/161 X |
| 4,375,054 | 2/1981 | Pavio | 333/116 |
| 4,394,630 | 9/1981 | Kenyon et al. | 333/116 |
| 4,394,633 | 4/1981 | Klein | 333/238 |
| 4,433,314 | 2/1984 | Hislop et al. | 333/246 X |
| 4,521,755 | 6/1985 | Carlson et al. | 333/238 X |

FOREIGN PATENT DOCUMENTS 1931228 1/1970 Fed. Rep. of Germany ..... 333/243

OTHER PUBLICATIONS

"Microstrip Wiring Applied To Microwave Receivers", Federal Telecommunication Laborotories, Lancaster Press, Lancaster, PA, copyright 1953; pp. 1-9.

*Primary Examiner*—Marvin L. Nussbaum

*Attorney, Agent, or Firm*—Louis Etlinger; David J. Thibodeau, Jr.

[57] ABSTRACT

A precision microwave delay line fabricated using stripline techniques, but having features of a coaxial transmission line. The delay line is assembled from three pieces: a center board, an upper housing, and a lower housing. The center board is a nonconductive substrate with a stripline conductor. The stripline conductor defines a transmission path. The housings are made of conductive material. A channel is formed on the inner surface of each of the housings. The channels are arranged such that when the center board is sandwiched between the housings, the transmission path is contained within a uniform cross-section cavity formed by the channels. The housings are electrically connected to each other through the center board with plated-through holes at locations along the sides of the transmission path.

28 Claims, 7 Drawing Figures

COMPACT DELAY LINE

FIELD OF THE INVENTION

The invention relates to passive microwave circuit structures, and in particular, to microwave transmission lines suitable for use as precision delay lines.

BACKGROUND OF THE INVENTION

A major problem with many microwave systems, such as digital instantaneous frequency measurement (DIFM) devices, is the size and cost of the precision delay lines required. Currently, hermetically sealed, stainless steel jacketed, semi-rigid coaxial transmission lines with silicon dioxide as the dielectric material are used. This provides a low dielectric loss and a temperature stable delay; however, in a typical DIFM configuration, the coaxial delay line occupies a large portion of the unit's total volume and accounts for a significant portion of the unit's weight.

Because of the size of these delay line assemblies, they are usually manufactured as a separate subassembly and attached via coaxial connectors to the rest of the DIFM circuit. The coaxial cable must be coiled in order to fit the delay line into a restricted space. The coiled cable assembly must be potted in order to make the delay line rigid and avoid variations in electrical characteristics due to motion of the cable. The manufacture of such coaxial delay line assemblies is thus a labor intensive operation. Further, because the coaxial delay lines have to be coiled to conserve space, they must be made with a dielectric that can support the center conductor during the coiling operation. Thus, they do not permit the use of air as the dielectric. An air dielectric is advantageous in precision delay lines because the properties of solid dielectric materials vary significantly with temperature and with frequency.

Microwave circuits can be formed using flat, layered structures such as stripline. A stripline circuit is a pattern of flat conductors sandwiched between a pair of flat, sheet-like ground plane conductors and spaced from the ground plane conductors by a pair of intervening sheets of dielectric material. U.S. Pat. Nos. 4,394,633, 4,394,630, 4,375,054, and 3,621,478 show various stripline structures.

Traditional stripline structures, however, have not been suitable for high frequency, precision delay lines. In typical prior art stripline structures it is difficult to maintain the TEM transmission modeas the dominant mode at frequencies above 18 Ghz.

It is an object of the present invention, therefore, to provide a microwave transmission line that is suitable for use as a precision delay line while being both compact in size and low in manufacturing cost.

It is a further object of the invention to provide a precision microwave delay line wherein the dielectric may be air.

SUMMARY OF THE INVENTION

A delay line incorporating the invention is similar to a stripline structure in that it comprises an inner conductor sandwiched between a pair of generally planar outer conductors. However, unlike conventional stripline devices, it can be configured to provide as air dielectric between the inner and the outer conductors.

The delay line is assembled from three pieces: a center board, an upper housing, and a lower housing. The center board is a nonconductive substrate for a stripline conductor which defines a transmission path. The housings, which are made of conductive material, serve as stripline outer conductors. Specifically, a channel is formed on the inner surface of each of the housings. The channels are arranged such that when the center board is sandwiched between the housings, the transmission path is contained within the cavity formed by the channels.

The resulting delay line structure of the present invention approximates the electrical characteristics of a coaxial transmission line: the stripline is the center conductor; the inner surfaces of the channels in the housings, together with electrical connections between the housings, form the outer conductor. This structure has numerous advantages over delay lines made using coaxial transmission line. The three-piece structure is inherently rigid, contrasted with delay lines made from coiled coaxial cable which require potting in order to be physically, and therefore electrically, stable. The three-piece structure is also more easily manufactured than delay lines made using coaxial transmission lines, volume reductions of about one half can be achieved, and an air dielectric can be used.

DESCRIPTION OF THE PREFERRED EMBODIMENTS

Figure 1:
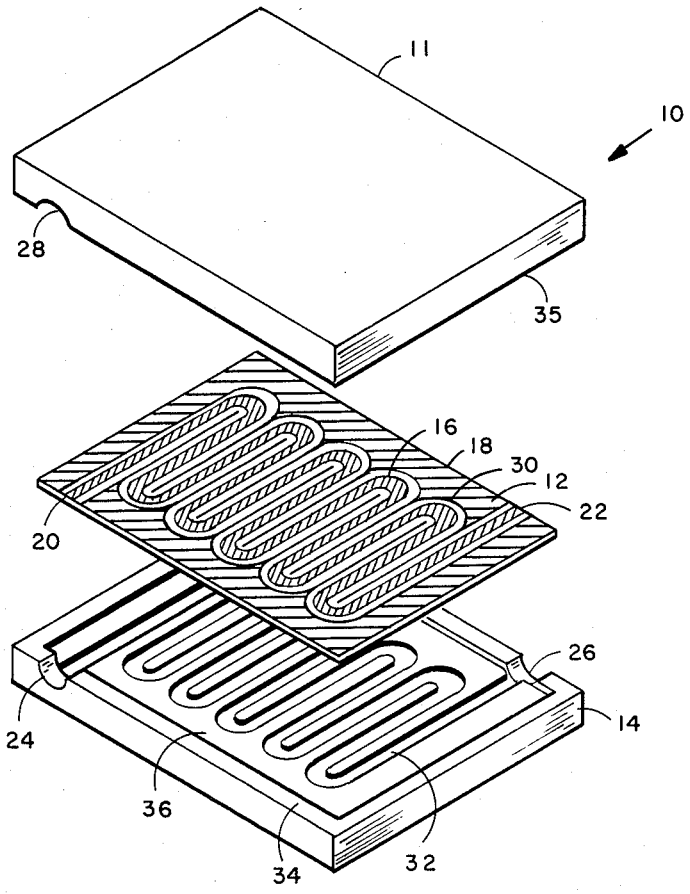
FIG. 1 is an exploded view of a delay line according to the present invention, showing the upper housing, the center board, and the lower housing.

As shown in FIG. 1, a delay line 10 embodying the present invention comprises an upper housing 11, a center board 12, and a lower housing 14. On the upper surface of the center board 12 is a conductive pattern (a transmission strip) 16 which defines a meandering uniform width transmission path between a port 20 and a port 22. A conductive surface 18 covers the remainder of the board 12 except for conductor-free regions 30 that surround and follow the contours of transmission strip 16.

On the lower surface (not shown in FIG. 1) of center board 12 are conductive patterns 38 and 44 and conductor-free regions 54 (shown in FIG. 2) which are the mirror images of the patterns 16, 18 and 30, respectively, on the upper surface of the board 12. A plurality of plated-through holes 50 electrically connect patterns 16 and 38, and a plurality of plated-through holes 48 electrically connect patterns 18 and 44. The locations of these holes 48 and 50 are shown in FIG. 3. Thus, the two conductive portions 16, 18 on the upper surface are electrically connected with their corresponding portions 38, 44 on the lower surface of center board 12.

The housings 11 and 14 are metal pieces, the inner surfaces of which are constructed to define a uniform cavity around the transmission path when the delay line 10 is assembled. Thus, the inner surface of the lower housing 14 includes a channel 32 which runs between connector apertures 24 and 26. The locations of the apertures 24 and 26 correspond to the locations of the ports 20 and 22, respectively, on the center board 12. The path of the channel 32 corresponds to the path of the transmission strip 38. The width of the channel 32 is such that the surface 36 surrounding the channel 32 is shaped in the same pattern as conductive surface 44.

The inner surface of the upper housing 11 defines a channel 40 between two connection apertures (one of which is shown at 28). The channel 40 and the apertures on the upper housing 11 are the mirror image of the channel 32 and the apertures 24 and 26 on lower housing 14.

A lip 34 around the perimeter of the lower housing 14 fits around the edge of center board 12 when the delay line 10 is assembled. The height of lip 34 is one half the thickness of the center board 12. When the delay line 10 is assembled, lip 34 contacts a similar lip 35 on the upper housing 11, thereby accurately positioning the board 12 and the conductive patterns located thereon. Further, when the delay line 10 is assembled, surface 36 contacts pattern 44 on the lower surface of the center board 12. Likewise, a similar surface 46 on the upper housing 11 contacts pattern 18. There is no contact between either housing 11 or 14 and either transmission strip 16 or 38.

Figure 2:
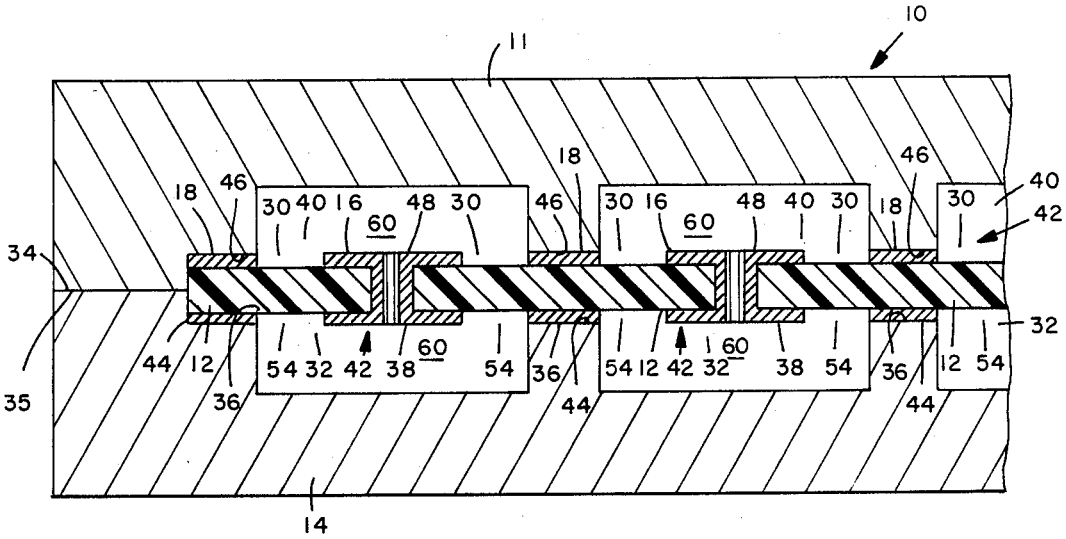
FIG. 2 is a cross section through a portion of a delay line assembled from the three elements shown in FIG. 1.
Figure 3:
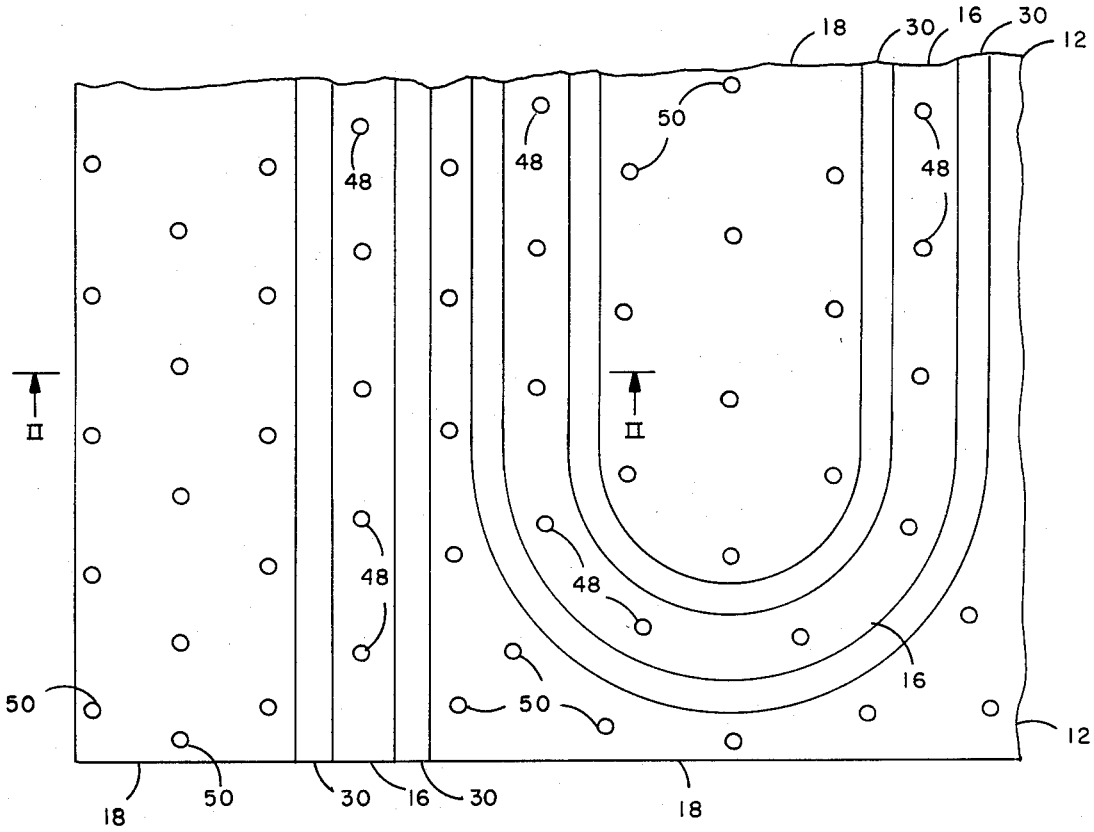
FIG. 3 is a fragmentary enlargement of the center board of FIG. 1 showing the pattern of plated-through holes interconnecting the conductive patterns on opposite sides of the board.

FIG. 2 shows a cross section of a portion of an assembled delay line such as in the plane II—II of FIG. 3. The channels 32 and 40 in the lower 14 and upper 11 housings, respectively, define a cavity 42 containing the transmission strips 16 and 38, which form the inner conductor. Between each of the adjacent sections of the cavity 42 there is electrical connection between the upper housing 11 and the lower housing 14: the surface 36 of the lower housing 14 connects to the conductive surface 44 on the lower surface of the center board 12; conductive patterns 44 and 18 on the lower and upper surfaces, respectively, of the center board 12 are electrically connected by a plurality of plated-through holes 48; and the conductive surface 18 contacts the surface 46 on the upper housing 10.

The housings 11 and 14 are formed by such processes as machining or die casting. The substrate of the center board 12 is a sheet of insulating material of a type used for printed circuit boards. This sheet is initially metalized on both sides. The conductive patterns 16, 18, 38, and 44 are then formed by etching away the metal in the regions 30 (on the upper surface of the center board 12) according to techniques well known in the art.

To assemble the delay line 10, the conductive patterns 16, 18, 38 and 44 on the center board 12 are preferably first tinned with solder. Then, the center board 12 is sandwiched between the two housings 11 and 14. This assembly is then heated to reflow the solder to make both mechanical and electrical connections between the housings 11 and 14 and the conductive patterns 18 and 44, respectively.

The assembled delay line 10 is connected to other circuit components by connecting through apertures 24 and 26 to the tinned surfaces at ports 20 and 22, respectively.

The electrical characteristics of the delay line 10 are similar to those of a coaxial transmission line. As in a coaxial transmission line, the center conductor (the transmission strips 16 and 38) is essentially completely surrounded by the outer conductor (the surfaces of the housings 10 and 14 which define channels 32 and 40, together with the plated-through holes 48). Because, by necessity, the holes 50 are spaced from each other by some distance, there are gaps in the outer conductor. This spacing is made sufficiently small, however, e.g., less than one eighth wavelength, such that the outer conductor is rendered effectively continuous for operation of the delay line 10.

Because the transmission strips 16 and 38 are located on opposite sides of the center board 12 and are at the same electrical potential, there is negligible electric field within the dielectric substrate of the center board 12. Thus, the electrical properties of the dielectric material in the board 12 have a negligible effect on the characteristics of the delay line 10. The only dielectric material that affects the electrical properties of the delay line is the material in the channels 32 and 40. Since the material in these channels does not support the center conductor, the material can be air as at 60. Air is a desirable dielectric because of its temperature stability and frequency independent characteristics.

Alternatively, one can use dielectrics at 60 other than air. While not having the advantages of an air dielectric, this alternative still does benefit from the advantages of an inherently rigid design and low manufacturing cost. Filling the cavity 42 with a material having a higher dielectric constant than air (e.g., silicon dioxide, alumina, magnesium titanate, barium tetratitanite, titanium dioxide) reduces transmission speed, thus providing greater delay per length of transmission line. Dielectric materials can be injected into the cavity of the delay line after the three elements have been assembled.

Figure 6:
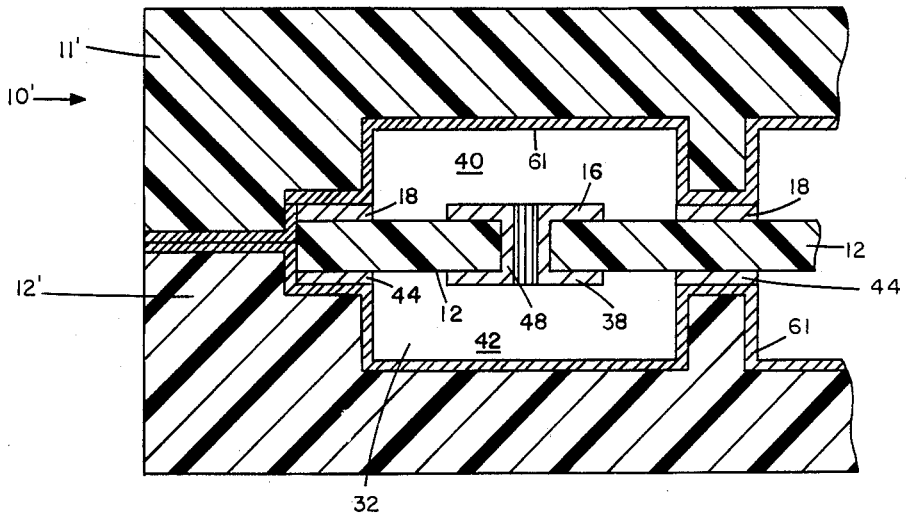
FIG. 6 is a cross section through a delay line of the present invention in an alternate embodiment.

As depicted in FIG. 6, the housings 11' and 14' can be made of a material which is easily molded, and need not be conductive. If a nonconductive material is used, the inner surface of each housing can be plated with a conductive layer 61.

Figure 4:
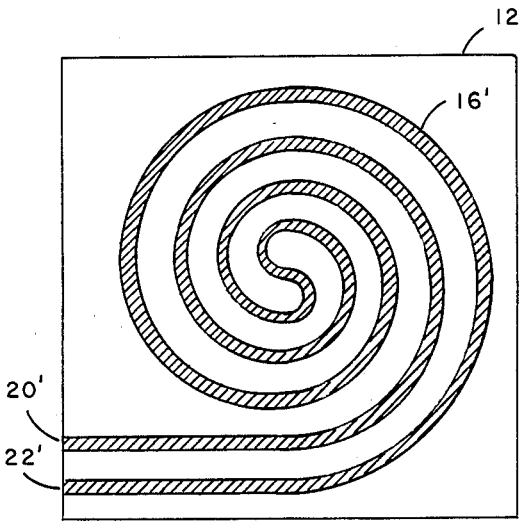
FIGS. 4 and 5 show alternative patterns for the transmission path in the delay line of the present invention.
Figure 5:
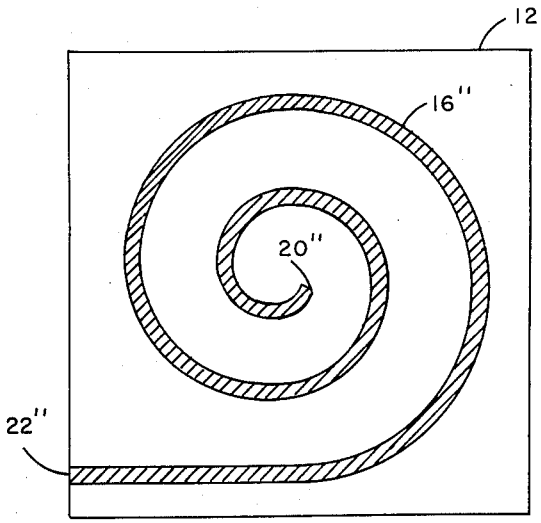

Various patterns can be used for arranging a long transmission path within the desired area of a center board. Three such patterns, one serpentine and two spiral, are shown in FIGS. 1, 4 and 5. With the serpentine pattern of FIG. 1 and the spiral of FIG. 4, both connecting points (ports 20 and 22 in FIG. 1, and 20' and 22' in FIG. 4) to the center conductor are at the edges of the center board 12. With the spiral pattern of FIG. 5, one of the connecting points, 20'' is in the center of the center board 12, and the other connecting point 22'' is at an edge of the center board 12.

Figure 7:
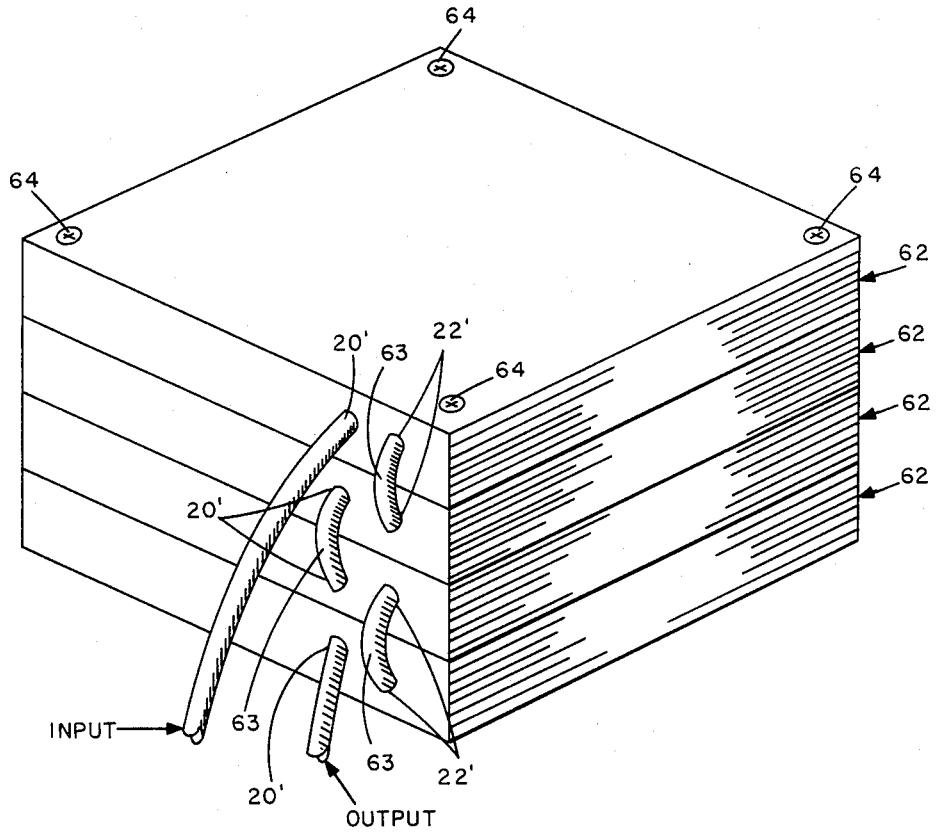
FIG. 7 shows in perspective the stacking capability of the present invention.

As a particular benefit of the present invention, as depicted in FIG. 7, the delay line modules 62 can be formed with provisions for a series connection from one module 62 to another (such as cables 63) such that the modules 62 can be physically stacked and connected as with screws 64. Thus, one or a few standard delay line modules 62 can be manufactured, from which delay lines having various delays can be assembled by stacking various numbers of the standard delay line modules 62 as shown in FIG. 7.

Using the present invention, one can construct a delay line that has a ten nanosecond delay, has an insertion loss of less than 3 dB, has a loss variation of less than 0.1 dB over the 8 GHz to 12 GHz band, and yet occupies substantially less space than a conventional coaxial delay line.

In summary, the present invention enables one to make delay lines with the advantages both of coaxial and stripline structures. These delay lines provide the 100% shielding and the low insertion loss of coaxial transmission lines; yet, they can be manufactured in the small size and at the low-cost characteristic of stripline structures. They also permit the use of an air dielectric.

What is claimed is:

1. A transmission delay line comprising:

(a) a non-conductive center board on which a conductive meandering transmission strip is arranged in a pattern defining a uniform width transmission path for electromagnetic energy, (b) an upper housing, having a conductive surface shaped to form a channel, and (c) a lower housing, having a conductive surfaces shaped to form a channel, said channels being shaped such that together the channels form a uniform cavity that surrounds said transmission strip along a transmission path between a pair of input/output ports and wherein said conductive surfaces of said housings are each electrically connected to the other at a plurality of first locations adjacent to said channels such that a substantially complete electromagnetic shield is formed around said transmission path.

2. A transmission delay line as claimed in claim 1 wherein:

each of said housings is a single piece of conductive material.

3. A transmission delay line as claimed in claim 1 wherein:

said transmission strip is arranged on one face of said center board; and further comprising, a second transmission strip arranged on the opposite face of said center board in a pattern defining the same transmission path as the other transmission strip, said two transmission strips being electrically connected to each other through said center board at a plurality of second locations along said transmission path.

4. A transmission delay line as claimed in claim 1 wherein:

said plurality of first locations are each located within one-eighth wavelength of the electromagnetic energy being transmitted therethrough with respect to the next adjacent ones of said first locations.

5. A transmission delay line as claimed in claim 3 wherein:

(a) said plurality of first locations are each located within one-eighth wavelength of the electromagnetic energy being transmitted therethrough with respect to the next adjacent ones of said first locations; and, (b) said plurality of second locations are each located within one-eighth wavelength of the electromagnetic energy being transmitted therethrough with respect to the next adjacent ones of said second locations.

6. A transmission delay line as claimed in claim 1 wherein:

said cavity is filled with an air dielectric.

7. A transmission delay line comprising:

(a) a plurality of delay line modules connected in series wherein each of said modules comprises, a non-conductive center board on which a conductive meandering transmission strip is arranged in a pattern defining a uniform width transmission path for electromagnetic energy, an upper housing, having a conductive surface shaped to form a channel, and a lower housing, having a conductive surface shaped to form a channel, said channels being shaped such that together the channels form a uniform cavity that surrounds said transmission strip along a transmission path between a pair of input/output ports; and, wherein said conductive surfaces of said housings are each electrically connected to the other at a plurality of first locations adjacent to said channels such that a substantially complete electromagnetic shield is formed around said transmission path;

(b) one of said input/output ports on one of said modules is the input to the delay line;

(c) one of said input/output ports on another one of said modules is the output to the delay line; and, (d) the remaining ones of said input/output ports are interconnected to place the modules in series between said input and said output.

8. A transmission delay line as claimed in claim 7 wherein:

each of said housings is a single piece of conductive material.

9. A transmission delay line as claimed in claim 7 wherein:

said transmission strip is arranged on one face of said center board; and further comprising, a second transmission strip arranged on the opposite face of said center board in a pattern defining the same transmission path as the other transmission strip, said two transmission strips being electrically connected to each other through said center board at a plurality of second locations along said transmission path.

10. A transmission delay line as claimed in claim 7 wherein:

said plurality of first locations are each located within one-eighth wavelength of the electromagnetic energy being transmitted therethrough with respect to the next adjacent ones of said first locations.

11. A transmission delay line as claimed in claim 9 wherein:

(a) said plurality of first locations are each located within one-eighth wavelength of the electromagnetic energy being transmitted therethrough with respect to the next adjacent ones of said first locations; and, (b) said plurality of second locations are each located within one-eighth wavelength of the electromagnetic energy being transmitted therethrough with respect to the next adjacent ones of said second locations.

12. The method of manufacturing a transmission delay line comprising the steps of:

(a) forming a center board of a non-conductive material having a conductive material on both sides thereof;

(b) removing portions of said conductive material, on both sides, to form a pair of mirror image uniform width conductive meandering transmission strips extending between a pair of input/output ports, said removed portions comprising equal width strips one either side of each of said transmission strips;

(c) electrically interconnecting said transmission strips at a plurality of locations along the length thereof;

(d) forming upper and lower housings adapted to be placed in facing relationship to form a space therebetween for holding said center board, said housings each having a uniform width conductive channel therein adapted to fit over its adjacent transmission strip and the adjoining non-conductive strips between said ports when said center board is disposed between said housings;

(e) disposing said center board between said housings; and, (f) electrically connecting together said conductive channels of each housing at a plurality of locations adjacent said channels to form a substantially complete electro-magnetic shield around said transmission strip.

13. The method of manufacturing a transmission delay line comprising the steps of:

(a) forming a center board of a non-conductive material having a conductive material on both sides thereof;

(b) removing portions of said conductive material, on both sides, to form a pair of mirror image uniform width conductive transmission strips extending between a pair of input/output ports, said removed portions comprising equal width strips, one either side of each of said transmission strips;

(c) electrically interconnecting said transmission strips at a plurality of locations along the length thereof;

(d) forming upper and lower housings adapted to be placed in facing relationship to form a space therebetween for holding said center board, said housings formed from a solderable metal, and said housings each having a uniform width conductive channel formed of a solderable metal, and adapted to fit over its adjacent transmission strip and the adjoining non-conductive strips between said ports wherein said center board is disposed between said housing:

(e) disposing said center board between said housings;

(f) tinning said conductive channels of each housing with solder; and, (g) electrically connecting together said conductive channels of each housing by heating the assembled center board and housings to melt said solder to bond said housings and center board together, thereby forming a substantially complete electromagnetic shield around said transmission strip.

14. The method of manufacturing a transmission delay line comprising the steps of:

(a) forming a center board of a non-conductive material having a conductive material on both sides thereof;

(b) removing portions of said conductive material, on both sides, to form a pair of mirror image uniform width conductive transmission strips extending between a pair of input/output ports, said removed portions comprising equal width strips, one either side of each of said transmission strips;

(c) electrically interconnecting said transmission strips at a plurality of locations along the length thereof;

(d) forming upper and lower housings adapted to be placed in facing relationship to form a space therebetween for holding said center board, said housings formed from a non-conductive material, and said housings each having a uniform width channel, adapted to fit over its adjacent transmission strip and the adjoining non-conductive strips between said ports wherein said center board is disposed between said housings;

(e) plating said conductive channels and the adjoining surface of said housings with a solderable metal;

(f) disposing said center board between said housings;

(g) tinning said conductive channels and adjoining surfaces of each housing with solder; and, (h) electrically connecting together said conductive channels of each housing by heating the assembled center board and housings to melt said solder to bond said housings and center board together, thereby forming a substantially complete electromagnetic shield around said transmission strip.

15. A microwave transmission delay line, comprising:

a non-conductive center board having a top surface and a bottom surface;

a first meandering transmission strip disposed on the top surface of said center board;

a second meandering transmission strip disposed on the bottom surface of said center board which forms the mirror image of said first conductive strip;

a first conductive pattern disposed on the top surface of said center board, so as to surround and follow the contours of said first transmission strip while leaving a uniform width non-conductive region to each side of said first transmission strip;

a second conductive pattern disposed on the bottom surface of said center board, so as to surround and follow the contours of said second transmission strip while leaving a uniform width non-conductive region to each side of said second transmission strip;

means for electrically connecting said first transmission strip and said second transmission strip so that said first and said second transmission strips form the electrical equivalent of a single solid conductor;

means for electrically connecting said first conductive pattern and said second conductive pattern so as to form the electrical equivalent of a single solid conductor;

an upper housing having a conductive channel disposed therein on its lower surface, positioned adjacent to the top surface of said center board, and the channel shaped so as to form a uniform cavity which surrounds said first transmission strip, so that the lower surface of said upper housing contacts said first conductive pattern along substnaitally the entire area of said first conductive pattern;

a lower housing having a conductive channel disposed therein on its upper surface, positioned adjacent to the bottom surface of said center board, and the channel shaped so as to form a uniform cavity which surrounds said second transmission strip, so that the upper surface of said lower housing contacts said second conductive pattern along substantially the entire area of said second conductive pattern; and means for electrically connecting said upper housing conductive channel, said lower housing conductive channel, said first conductive pattern and said second conductive pattern so as to form a substantially complete electromagnetic shield around said first transmission strip and said second transmission strip.

16. A delay line as in claim 15 wherein said first and second meandering transmission strips follow a substantially serpentine path.

17. A delay line as in claim 15 wherein said first and second meandering transmission strips follow a substantially spiral path.

18. A delay line as in claim 15 wherein said upper housing is a single solid conductive material.

19. A delay line as in claim 15 wherein said lower housing is a single solid conductive material.

20. A delay line as in claim 15 wherein the conductive channel of said upper housing contains a dielectric material.

21. A delay line as in claim 15 wherein the conductive channel of said lower housing contains a dielectric material.

22. A delay line as in claim 15 wherein said means for electrically connecting said first transmission strip and said second transmission strip further comprises a plurality of electrical interconnections between said first transmission strip and said second transmission strip.

23. A delay line as in claim 22 wherein said plurality of electrical interconnections are each located within one-eighth wavelength of the electromagnetic energy being transmitted therethrough with respect to the next adjacent electrical interconnection.

24. A delay line as in claim 15 wherein said means for electrically connecting said first conductive pattern and said second conductive pattern further comprises a plurality of electrical interconnections between said first conductive pattern and said second conductive pattern.

25. A delay line as in claim 24 wherein said plurality of electrical interconnections between said first conductive pattern and said second conductive pattern are each located within one-eighth wavelength of the electromagnetic energy being transmitted therethrough with respect the next adjacent elelctrical interconnection.

26. A delay line as in claim 15 and further comprising:

a plurality of additional ones of said delay lines each of said delay lines having an input and output port; and means for interconnecting the input and output ports of said plurality of delay lines, in series.

27. A transmission delay line, comprising:

a non-conductive center board having a top surface and a bottom surface;

a meandering transmission strip disposed on the top surface of said center board;

a conductive pattern also disposed on the top surface of said center board, so as to surround and follow the contours of said first transmission strip while leaving a uniform width non-conductive region to each side of said transmission strip;

an upper housing having a conductive channel disposed therein on its lower surface, positioned adjacent to the top surface of said center board, and the channel shaped so as to form a uniform cavity which surrounds the transmission strip, so that the lower surface of said upper housing contacts said first conductive pattern along substantially the entire area of said first conductive pattern;

a lower housing having a conductive channel disposed therein on its upper surface, positioned adjacent to the bottom surface of said center board, and the channel shaped so as to form a uniform cavity below the transmission strip; and means for electrically connecting said upper housing conductive channel, said lower housing conductive channel, and said conductive pattern so as to form a substantially complete electromagnetic shield around said transmission strip.

28. The method of claim 14 and additionally including the step of:

filling said channels with a dielectric material.

* * * * *